US011608982B1

(12) United States Patent
Kelley

(10) Patent No.: US 11,608,982 B1
(45) Date of Patent: Mar. 21, 2023

(54) DRAFT INDUCER

(71) Applicant: Daniel P. Kelley, Falmouth, ME (US)

(72) Inventor: Daniel P. Kelley, Falmouth, ME (US)

( * ) Notice: Subject to any disclaimer, the term of this patent is extended or adjusted under 35 U.S.C. 154(b) by 0 days.

(21) Appl. No.: 17/944,771

(22) Filed: Sep. 14, 2022

(51) Int. Cl.

| | |
|---|---|
| ***F23L 17/16*** | (2006.01) |
| ***F23L 17/00*** | (2006.01) |
| ***F24B 1/189*** | (2006.01) |
| ***F24B 1/192*** | (2006.01) |
| ***F24B 1/187*** | (2006.01) |
| ***F23B 60/00*** | (2006.01) |
| ***F23M 11/02*** | (2006.01) |
| *F23L 1/00* | (2006.01) |

(52) U.S. Cl.
CPC ..... *F23L 17/16* (2013.01); *F23B 60/00* (2013.01); *F23L 17/005* (2013.01); *F23M 11/02* (2013.01); *F24B 1/187* (2013.01); *F24B 1/189* (2013.01); *F24B 1/192* (2013.01); *F23L 1/00* (2013.01)

(58) Field of Classification Search
CPC ..... F23L 17/16; F23L 17/005; F23L 1/00; F23M 11/02; F23B 60/00; F23B 60/02; F24B 1/00; F24B 1/187; F24B 1/189; F24B 1/19; F24B 1/192
USPC ..... 126/502, 549, 521, 545, 544
See application file for complete search history.

(56) References Cited

U.S. PATENT DOCUMENTS 165,604 A * 7/1875 McHenry ..... F24B 1/192 126/550
169,585 A * 11/1875 Reid ..... F24B 1/192 126/548
624,984 A * 5/1899 Scanlan ..... F24B 1/192 126/547
1,673,203 A * 6/1928 Rief ..... C10J 1/18 431/183
1,743,048 A * 1/1930 Sleaster ..... F23L 17/005 251/304
1,769,497 A * 7/1930 Davison ..... F23L 1/02 126/110 A
1,770,588 A * 7/1930 Cook ..... F23L 1/02 236/16
4,112,914 A * 9/1978 Brown ..... F24B 1/18 126/502
4,178,908 A * 12/1979 Trexler, Sr. ..... F24B 1/1886 126/502
4,190,034 A 2/1980 Wonisch
4,240,403 A * 12/1980 Bader ..... F24B 7/025 126/286
4,362,147 A * 12/1982 Taglavore ..... F24B 1/192 126/547
4,810,173 A 3/1989 Thomson et al.
5,090,897 A * 2/1992 Christenson ..... F23D 14/74 239/405
5,218,953 A 6/1993 Shimek et al.
5,673,683 A 10/1997 Beal et al.
(Continued)

FOREIGN PATENT DOCUMENTS

CA 2189214 A1 * 10/1996 ..... F24B 1/188
FR 2671167 A1 * 7/1992 ..... F23L 17/16
(Continued)

*Primary Examiner* — Steven B McAllister
*Assistant Examiner* — Daniel E. Namay

(57) ABSTRACT

A portable draft inducer is adapted to assist a user in starting a fire in a fireplace and to prevent smoke from the newly ignited fire from entering an adjoining room when the fire is first started.

7 Claims, 7 Drawing Sheets

(56) References Cited

U.S. PATENT DOCUMENTS

| | | | | |
|---|---|---|---|---|
| 8,800,542 | B1 * | 8/2014 | Kennington | F24B 15/005 99/333 |
| 10,006,464 | B2 | 6/2018 | Prior et al. | |
| 11,047,577 | B2 | 6/2021 | Dang | |
| 11,209,167 | B1 * | 12/2021 | Gutierrez | A47G 5/04 |
| 2003/0183220 | A1 * | 10/2003 | Herres | F24B 1/19 126/527 |
| 2015/0144124 | A1 * | 5/2015 | Olson | F24B 15/002 126/21 A |
| 2021/0388989 | A1 * | 12/2021 | Thom | F24B 1/19 |

FOREIGN PATENT DOCUMENTS

| | | | | |
|---|---|---|---|---|
| GB | 2441779 | A * | 3/2008 | F23L 1/02 |
| WO | WO-2008129087 | A1 * | 10/2008 | F23L 17/005 |

* cited by examiner

DRAFT INDUCER

BACKGROUND INFORMATION

Field of the Invention

The invention relates to devices that assist an operator in starting a fire in a fireplace.

Discussion of Prior Art

A fireplace is a structure commonly made of brick, stone, or metal and that is designed to contain a fire. While they were historically used to heat a dwelling, for cooking and heating water for domestic purposes, today they are more commonly used to create a relaxing ambiance.

The fire itself is contained in a portion of the fireplace commonly referred to as the firebox, with a chimney or flue located above the firebox to vent gas and smoke.

Fireplaces work well once the fire is started. However, initiating the fire is often problematic and it is common for some amount of smoke to enter the room where the fireplace is constructed, thus negating much of the relaxing ambiance the fireplace is intended to create. An additional complication may also arise in starting and building the fire.

What is needed, therefore, is a device that is able to prevent smoke from entering a room and cause it to exit through the chimney. What is further needed is a device that helps initiate the fire.

BRIEF SUMMARY OF THE INVENTION

The invention is a portable draft inducer that prevents smoke from a fire in a fireplace from entering the adjoining room when the fire is first started. More specifically, the draft inducer device comprises a fire resistant shield and an air blowing system that prevents smoke from entering a room and directs smoke out through the chimney.

The shield is slightly larger than the opening of the fireplace and includes a barrier, such as a flame retardant foam, around an outer edge of the shield so that the device may be placed against the fireplace in a manner that creates a seal while not damaging the fireplace.

The air blowing system includes an air blower device positioned on the non-fire side of the shield and heat resistant piping that extends from the blower through the shield and into the firebox. The outlet of the piping in the firebox is angled upward so as to direct the smoke towards the back of the firebox where a damper is typically positioned.

The piping also includes a second outlet that is directed downward towards the bottom and back of the firebox where the fire is typically located so as to provide additional air to help start the fire.

When a user wants to start a fire, he or she moves the device near the fireplace and ignites a small amount of kindling using conventional techniques. The user then immediately places the device in front of the fireplace and presses it against the fireplace to create an airtight seal and then activates the blower device. Once the blower is activated, it both helps to grow the flame while also helping to send the smoke to the chimney. In general, the device only needs to be operated for 10-20 seconds in order to have a smoke-free fire in the fire place, after which the device may be removed and stored as the user enjoys the fire.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
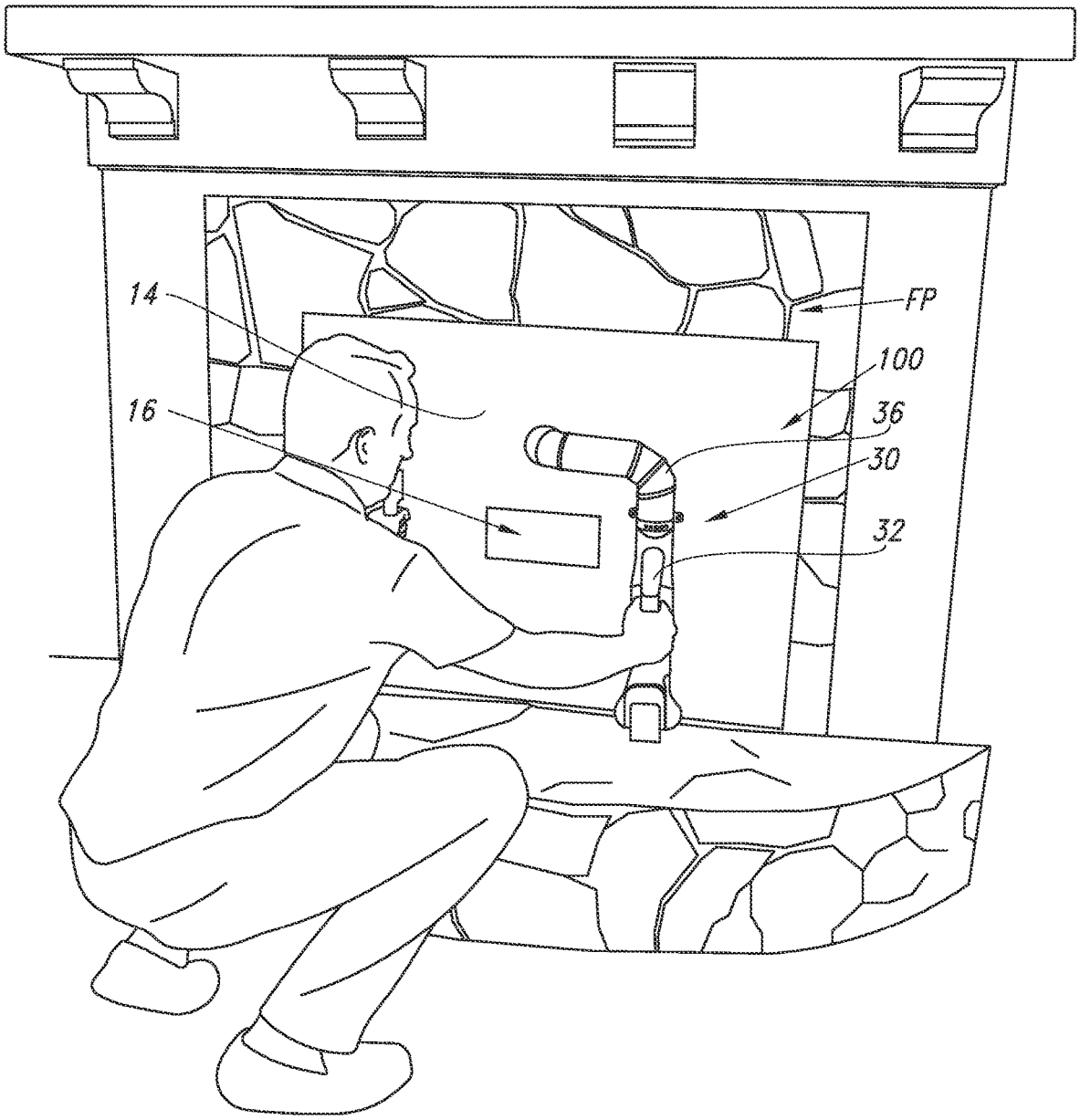
FIG. 1 is a front view of the device according the invention in use against a fireplace.
Figure 2:
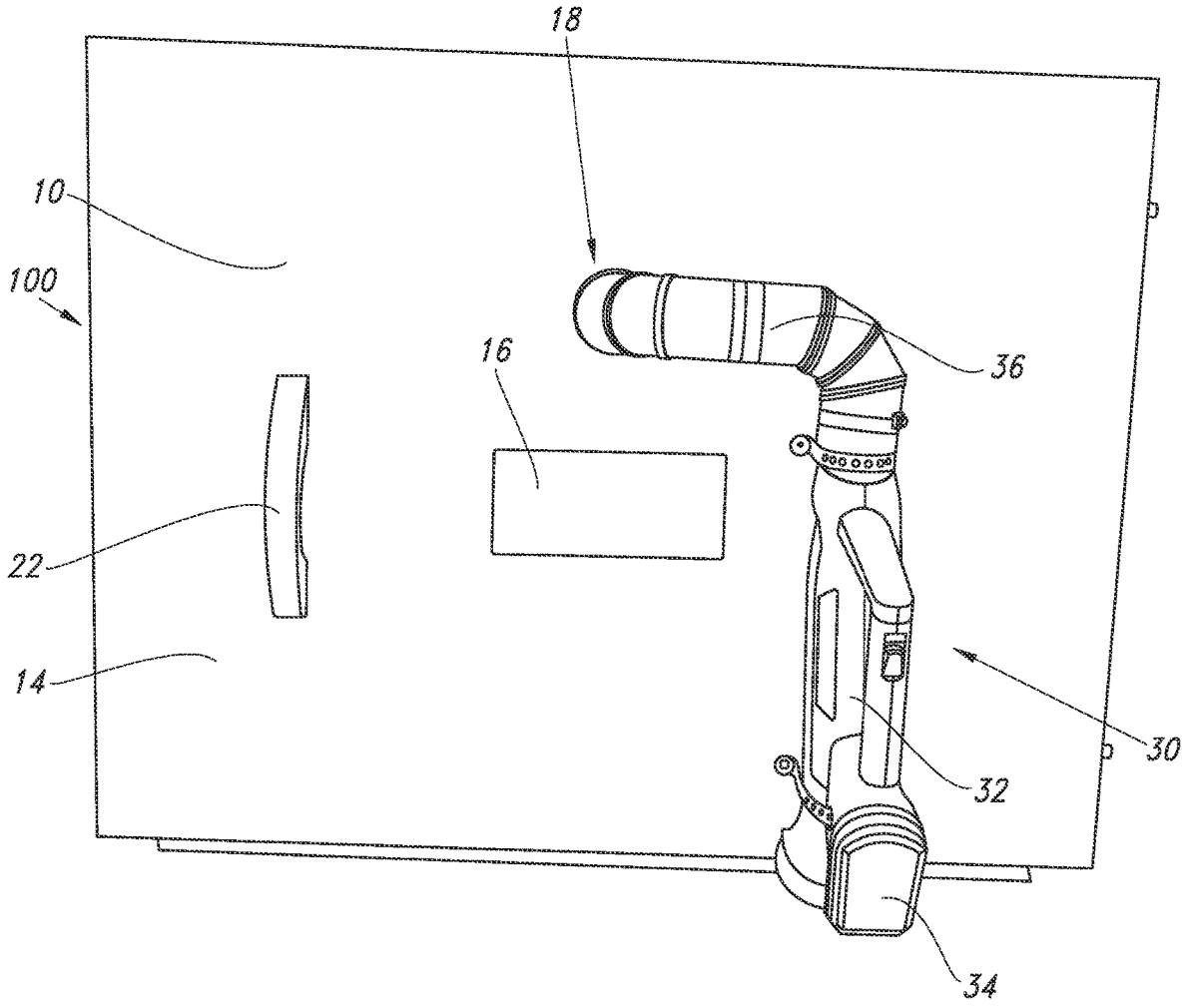
FIG. 2 is a front view of the device according to the invention.
Figure 3:
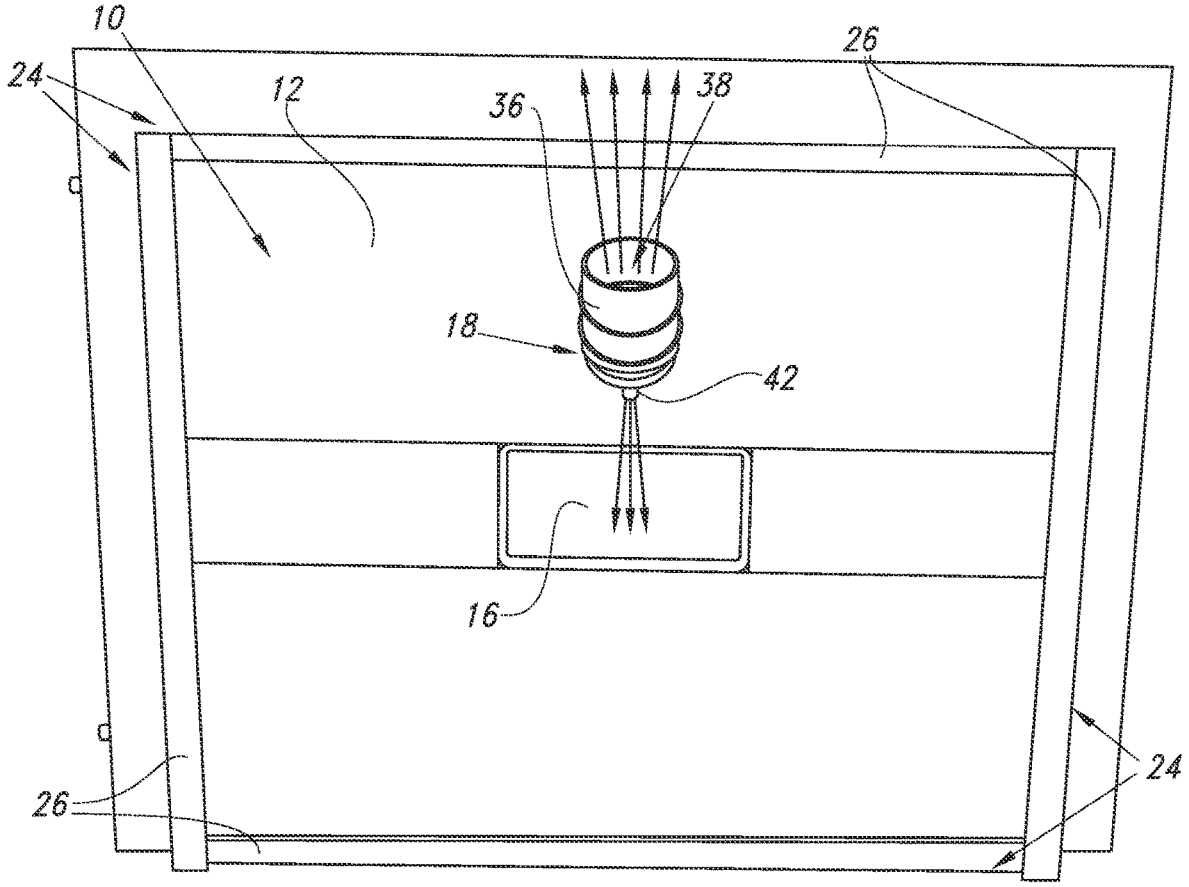
FIG. 3 is a rear view of the device.
Figure 4:
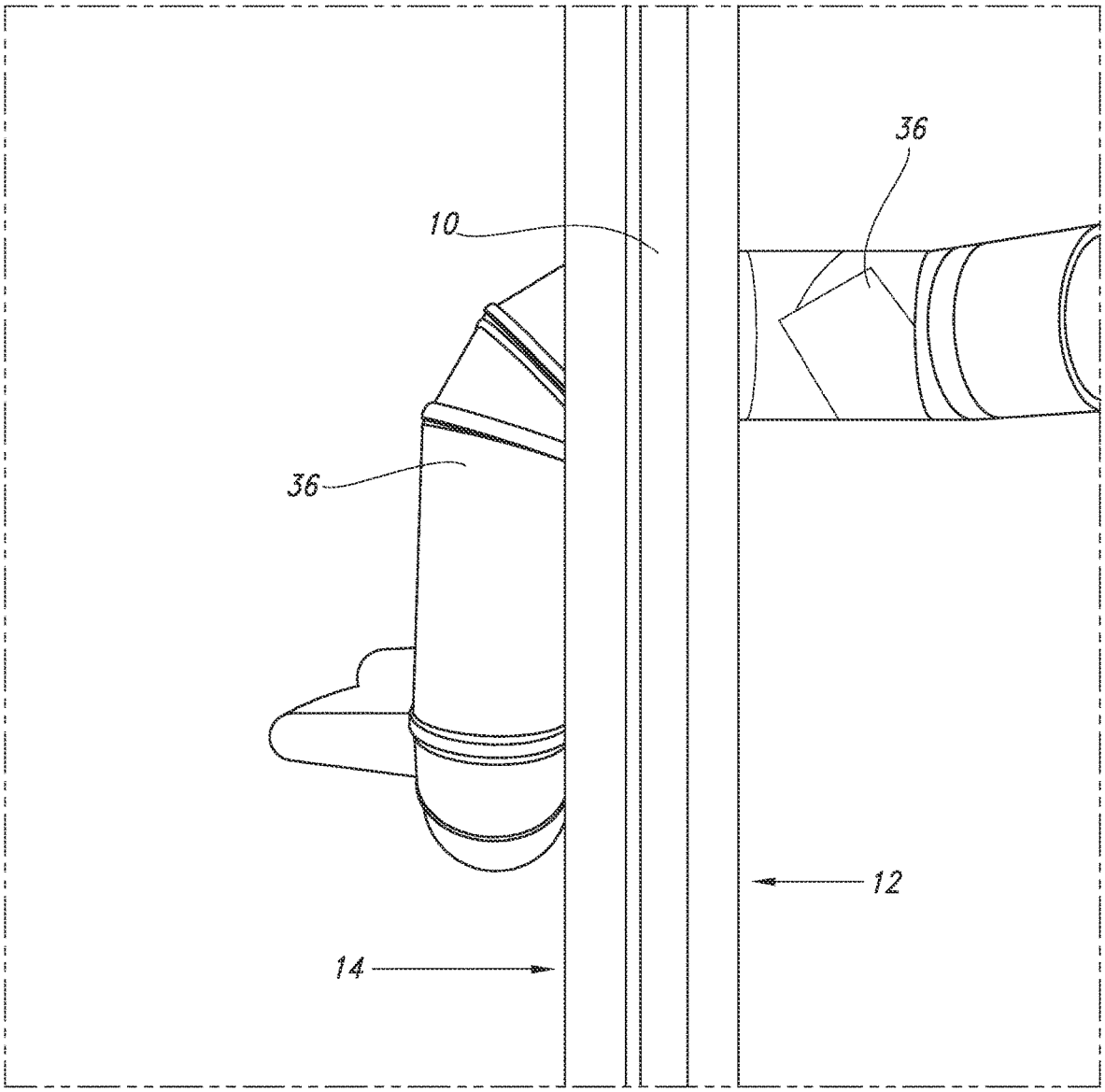
FIG. 4 is a partial top view of the device.
Figure 5:
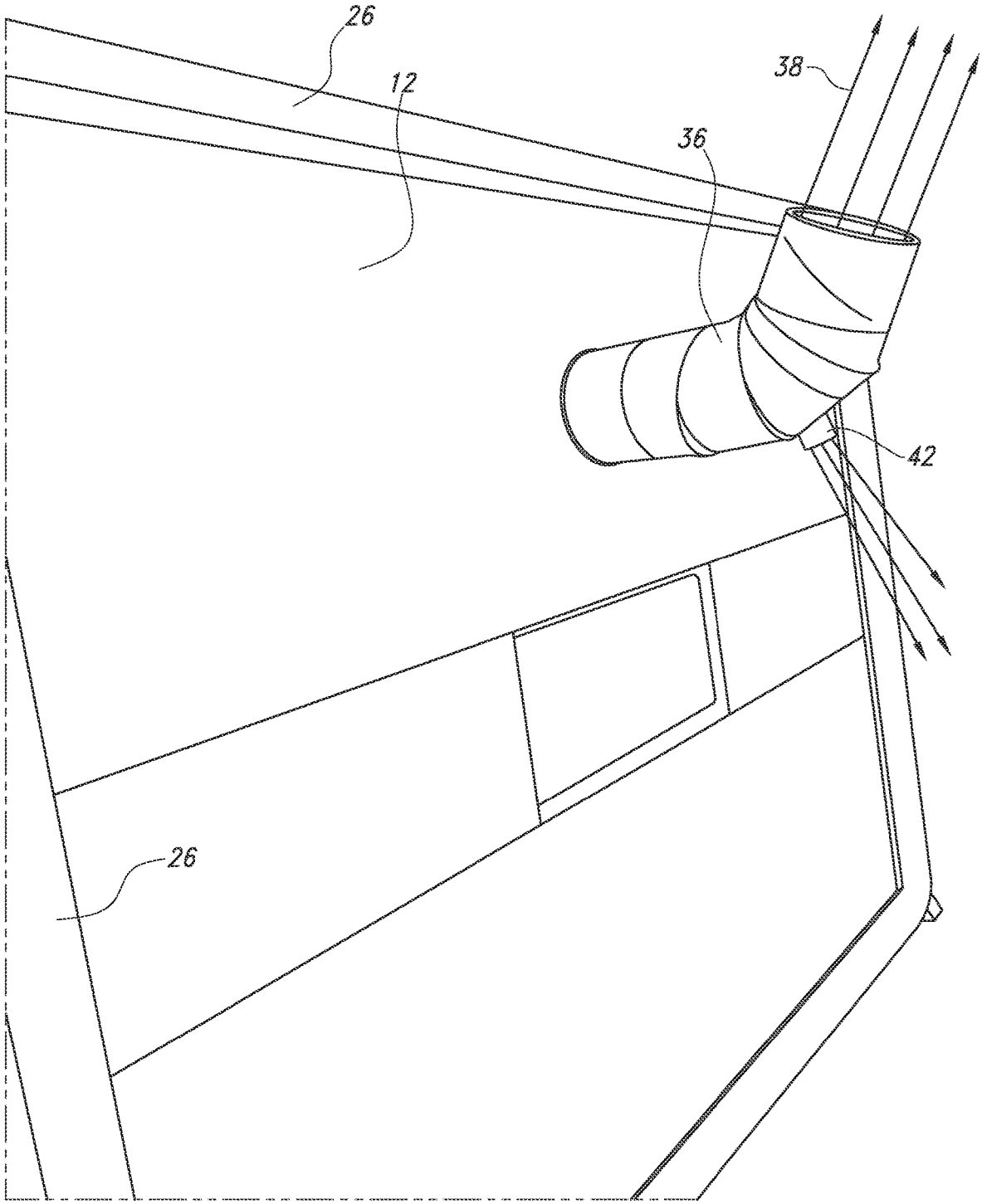
FIG. 5 is a side perspective view of the device showing the rear side of the device.
Figure 6:
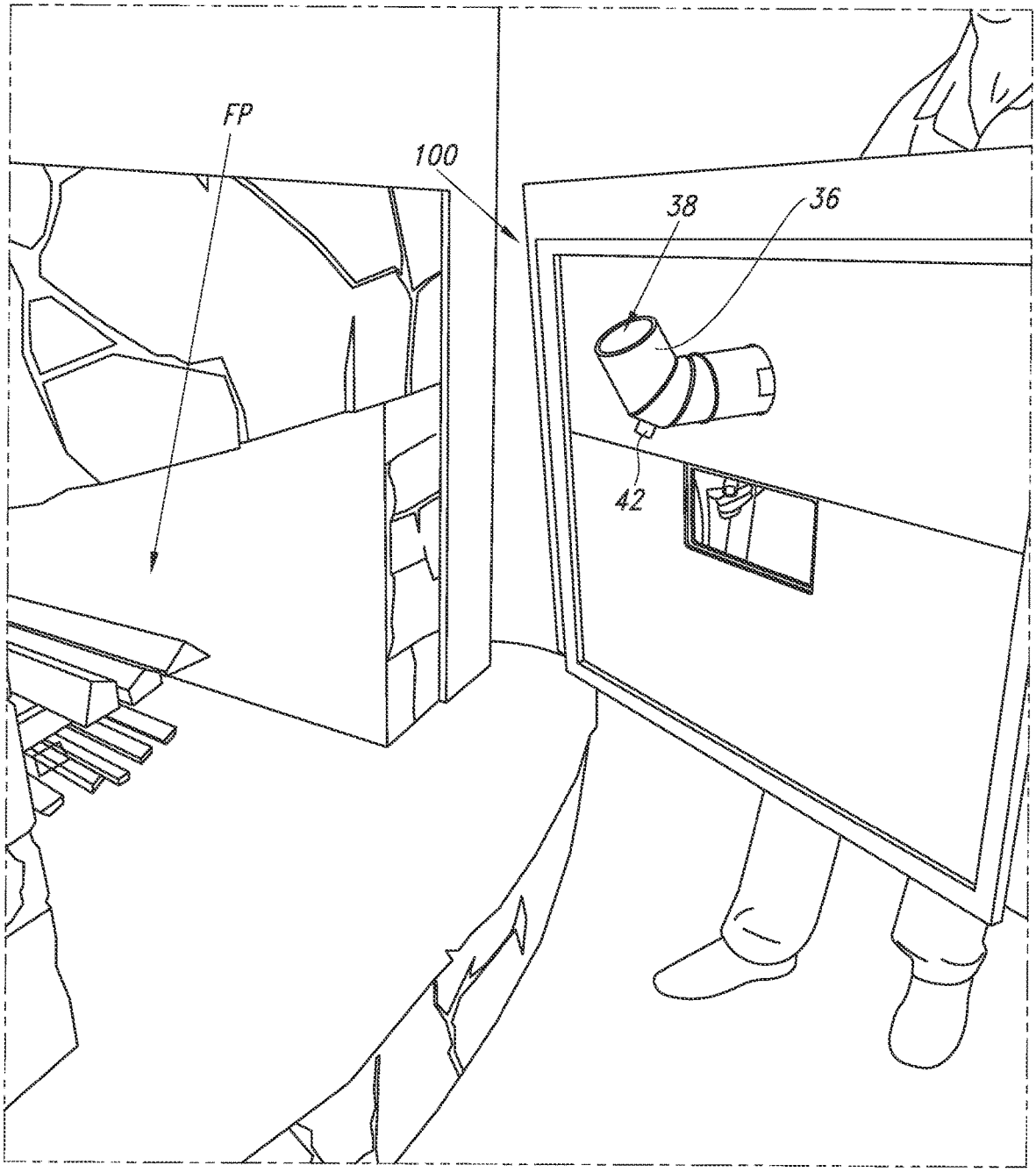
FIG. 6 is a perspective view of the device near a fireplace.
Figure 7:
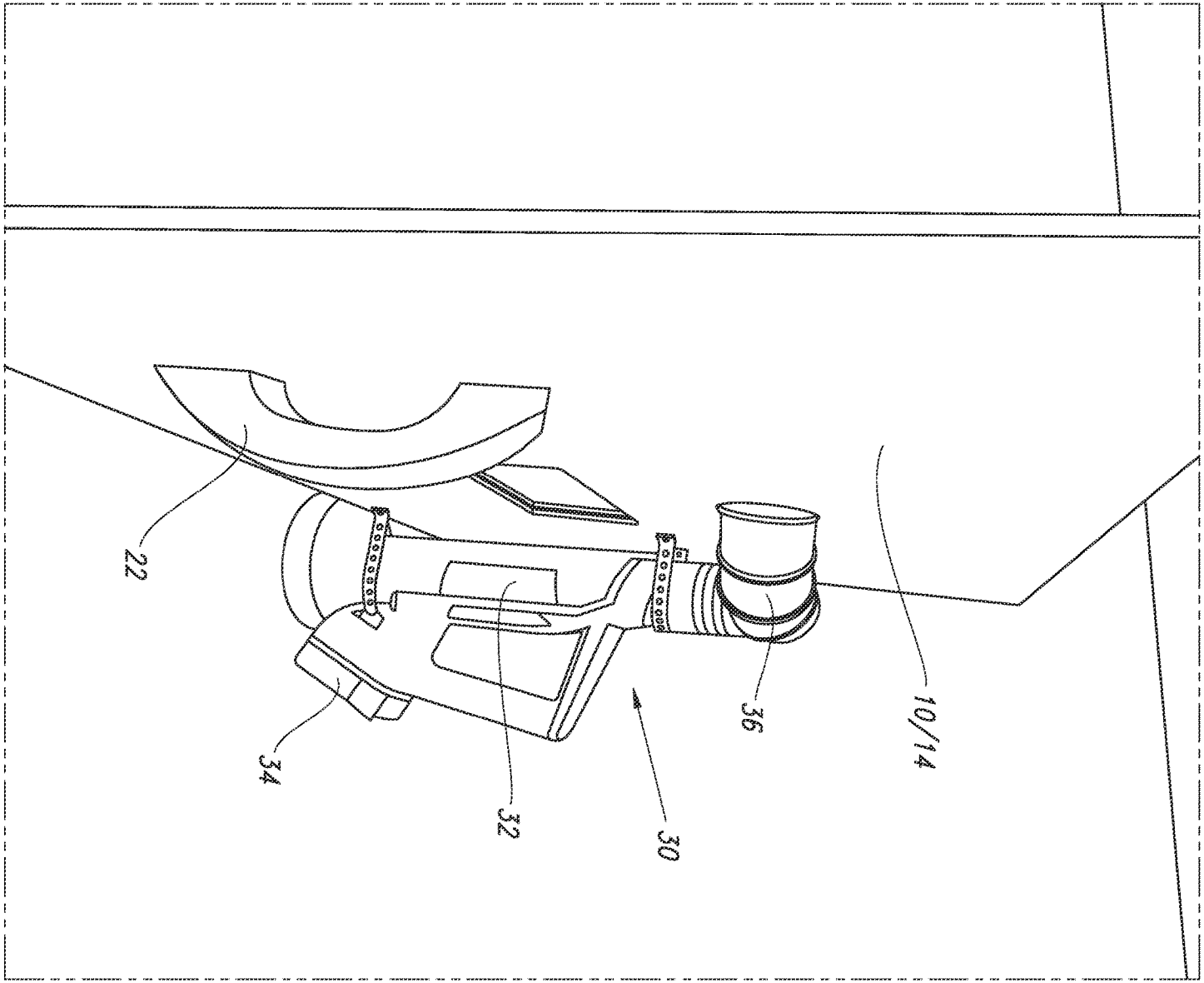
FIG. 7 is a perspective view showing the front and side.

FIGS. 1-7 illustrate a draft inducing device 100 that is configured to prevent smoke from entering a room when starting a fire in an open fireplace FP. The device 100 includes a fire shield 10 that creates an airtight seal around the opening of the fireplace and that has an air blowing system 30 that directs smoke away from the room and out through the chimney.

To use the device 100 to start a fire, the operator first constructs a kindling base inside the fireplace. Next, the fireplace flue damper is opened and the kindling lit. The device is quickly positioned firmly against the fireplace opening and the blower is activated. After the blowing system 30 has been operating for roughing 15 to 20 seconds the draft and fire should be sufficiently established. Once the fire is established the device may be removed, and larger pieces of firewood may be added without smoke entering the room.

The shield 10 is either made of a fire resistant material or covered in one. For example, it may be made of a stamped piece of aluminum. Or, it may be made of plywood and covered in a fire resistant covering or coating, for example, thermotape that is heat resistant up to 1000 degrees Fahrenheit.

The shield 10 has a first side 12 that is intended to be placed against the fireplace and a second side 14 that is on the operator's side. A viewing window 16 exists in the shield so that an operator may observe the fire so that the operator does not move the device 100 away from the fireplace before the fire is established and the smoke has cleared. An opening 18 also exists in the shield 10 so that the blowing system 30 may extend through the shield such that the operator may control the air from the non-fire side of the device.

An outer edge 24 of the first side 12 is covered in a non-abrasive heat resistant material 26 that may be placed firmly against the fireplace so as to create an air-tight, or nearly air-tight, fit between the device 100 and the fireplace without damaging the fireplace. For example, a heat resistant foam.

The air blowing system 30 includes a blowing device 32 that moves air in a specific direction. The blowing device 32 is coupled to fire shield 10 second side 14 using conventional means such as clamps. Any amount of air movement is beneficial, but a higher rate of speed leads to better and faster results. For example, an air movement speed over 70 miles per hour results in a smoke free fire within approximately 20 seconds. As a more specific example, the blowing device is similar in capability, and may be similar in structure, to many conventional leaf blowers, such as the RYOBI ONE+ leaf blower that uses an 18 volt battery and provides air at a rate of approximately 90 miles per hour. The blowing device is preferably cordless and powered by an easily portable battery 34. The blowing device is connected to conventional heat resistant piping 36 that extends from the blowing device 32 and through the blower opening 18. The piping 36 is secured in the opening 18 using conventional means in a manner that prevents smoke from passing through the opening and into the room, for example, by being sized and shaped to create a secure fit and using clamping devices to hold the piping 36 in a desired position. A fire resistant sealant may also be used to secure the piping 36 in the opening 18. After the heat resistant piping extends through the shield it extends a number of inches so that, when the device 100 is in the operating position the end of the piping is near a midpoint of the fireplace, for example, the piping may extend approximately 6 or 7 inches beyond the first side 12.

The end 38 of the piping is open and angled upward so as to blow air towards the back of the firebox and towards the damper, for example, it may have an upward angle of approximately 45 degrees. An outlet 42 that is angled downward may also be provided to direct air towards the fire to help it grow at a faster rate.

A handle 22 may also be provided on the second side 14 to assist the operator in establishing and maintaining the proper position of the device against the fireplace and to move the device to a storage area when it is not in use.

The device 100 may be made in a variety of sizes, but it is preferable if the standard device is large enough to cover most conventional fireplaces. For example, most fireplaces have an opening that is between 24 inches and 36 inches in width and between 24 inches and 29 inches in height. As such, providing a shield 10 that is approximately 41 inches in width and approximately 32 inches in height is suitable, allowing for the non-abrasive heat resistant material 26 to have a width of approximately 1 inch as it runs around the outer edge 24.

It is understood that the embodiments described herein are merely illustrative of the present invention. Variations in the construction of the draft inducer may be contemplated by one skilled in the art without limiting the intended scope of the invention herein disclosed and as defined by the following claims.

What is claimed is:

1. A draft inducing device adapted to work with a fireplace that has a firebox with an opening and a chimney, the draft inducing device comprising:

a fire shield that has a fire shield first side and a fire shield second side and a height and a width, the height and width greater in size than a height and width of the opening of the firebox, the fire shield including a fire shield opening that extends from the fire shield first side to the fire shield second side;

an air blowing system that includes a blowing device and piping, the blowing device powered by a portable power supply, the blowing device configured to blow air and coupled to the fire shield second side, the piping having a first piping end and a second piping end, the first piping end connected to the blowing device, the piping extending from the blowing device through the fire shield opening where the second piping end is located beyond the first side, the piping sealed in the fire shield opening;

wherein the fire shield is configured to be removably placed against the fireplace opening such that the fire shield covers the opening of the firebox, and the blowing device directs air into the fireplace and causes smoke from the fire to go up the fireplace's chimney;

and wherein the second piping end has an opening and is angled upward.

2. The device of claim 1, wherein the piping secured in the fire shield opening in a manner that is configured to prevent smoke from passing through the fire shield opening.

3. The device of claim 1, wherein the fire shield including a viewing window.

4. The device of claim 1, the second piping end angled upwards at an approximately 45 degree angle.

5. The device of claim 1, wherein the fire shield first side having an outer edge that is covered in a non-abrasive fire resistant material.

6. The device of claim 1, wherein the piping including an outlet that is located near the second piping opening.

7. The device of claim 6, wherein the outlet is angled downward.

* * * * *